United States Patent [19]

Öberg

[11] 4,367,808

[45] Jan. 11, 1983

[54] SILENCER

[76] Inventor: Olov T. Öberg, 21 Strutsgatan, S-961 00 Boden, Sweden

[21] Appl. No.: 280,806

[22] Filed: Jul. 6, 1981

[51] Int. Cl.[3] ..... F01N 1/08

[52] U.S. Cl. ..... 181/272; 181/275

[58] Field of Search ..... 181/264, 268, 270, 272, 181/275, 251, 236

[56] References Cited

U.S. PATENT DOCUMENTS

| | | | |
|---|---|---|---|
| 797,681 | 8/1905 | Gray | 181/236 |
| 1,900,027 | 3/1933 | Radecky | 181/264 |
| 2,072,372 | 3/1937 | Kingsley | 181/264 |
| 2,740,616 | 4/1956 | Walden | 181/264 |

FOREIGN PATENT DOCUMENTS

| | | | |
|---|---|---|---|
| 970378 | 8/1956 | Fed. Rep. of Germany | 181/275 |

*Primary Examiner*—L. T. Hix
*Assistant Examiner*—Thomas H. Tarcza
*Attorney, Agent, or Firm*—Kinzer, Plyer, Dorn & McEachran

[57] ABSTRACT

A silencer for exhaust gases from combustion engines comprises a perforated pipe (1) provided with an inlet (2) and an outlet (3). Arranged in the interior of the pipe (1) are intermediate walls (12,13,14) provided with through-flow openings (15,16). Extending co-axially around the pipe (1) in spaced relationship therewith is a shell, and the space located between the shell and the pipe (1) is divided into a plurality of damping chambers (7,8,9) by means of partitions (10,11). Exhaust gases partly flow axially through the pipe (1) and partly from the pipe to the damping chambers and from there back into the pipe, where they mix with the axially flowing exhaust gases.

2 Claims, 2 Drawing Figures

SILENCER

The present invention relates to a silencer for the exhaust gases of internal combustion engines, comprising a perforated pipe having an inlet and an outlet; intermediate walls arranged within said pipe and connecting to the inner wall thereof; and an impermeable shell surrounding said pipe in a manner to form a space between the pipe and the shell, whereby said space is divided into a plurality of damping chambers by means of partitions which abut the pipe and the shell and which are located between said intermediate walls.

When dimensioned correctly, such exhaust silencers, which are described for example in U.S. Pat. No. 2,072,372, have been found to muffle the sound of exhaust gases very effectively. However, such silencers are relatively bulky and because of the high pulsation forces caused by the pressure surges in the exhaust gases place a relatively high demand on the enginer power.

Consequently the prime object is to provide a silencer of the aforementioned kind which is less bulky than the known silencer while retaining the same sound damping ability, or while having an improved sound damping ability, and which places less demand on the engine power.

This prime object is achieved mainly by providing each intermediate wall with a plurality of throughflow openings for causing exhaust gas to flow in the axial direction of the perforated pipe.

Exhaust gases which flow into the perforated pipe from one damping chamber will meet and mix with the axially flowing exhaust gas, thereby equalizing out the pressure surges and effectively reducing the sound generated by the exhaust gases, enabling the volume of the damping chambers to be decreased. There will also be less resistance to the flow of exhaust gases through the silencer, or muffler, with a corresponding decrease in engine-power losses.

Figure 1:
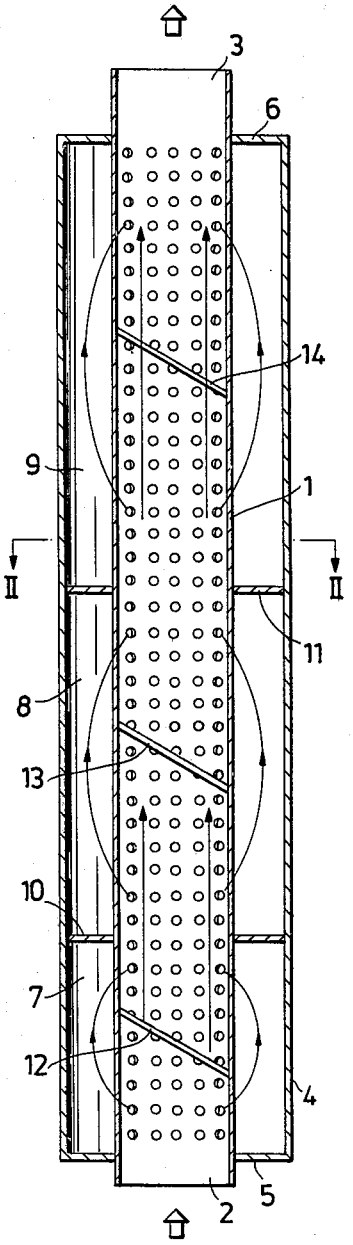
Figure 2:
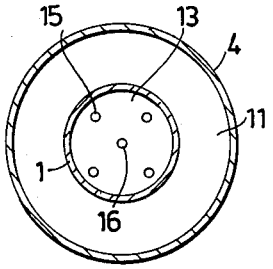

The invention will now be described in more detail with reference to the accompanying drawing, in which FIG. 1 is an axially sectional view of a silencer according to the invention, and FIG. 2 is a view taken on the line II—II in FIG. 1.

In the drawing there is illustrated a perforated pipe 1 made of sheet steel or some other suitable material. The pipe 1 has an inlet 2 for exhaust gases from a combustion engine and an outlet 3. Spaced around the perforated pipe 1 is a gas impervious shell 4 having end walls 5,6 which are sealingly to the outer surface of the pipe 1. Located between the perforated part of the pipe 1 and the shell 4 is a sound-damping or muffling space which is divided into a plurality of damping chambers 7,8,9 by means of partitions 10,11. The damping chambers 7,8,9 are in communication with one another through the perforated pipe 1.

The interior of the perforated pipe 1 is divided up by means of intermediate walls 12,13,14 which in the illustrated embodiment are oblique to the long axis of the pipe 1, but which could also extend at right angles to said axis. As will be seen, each of the partitions 10,11 lies approximately centrally between the pairs of walls 12,13 and 13,14 respectively. Each intermediary wall is provided with through-passing openings, e.g. the openings 15 and 16 shown in FIG. 2.

Exhaust gases under pulsating pressure fed into the silencer through the inlet 2 will flow, in a known manner, out through the perforated pipe 1 into a surrounding damping chamber, as shown in FIG. 1 by the curved arrows, and from there back into the pipe 1. Outflow of exhaust gas from said damping chamber takes place before or in front of a partition, as shown, since the pressure is greater in front of said partition than behind it, while the inflow of exhaust gas consequently takes place behind a partition. Because each intermediate wall 12,13,14 is provided with throughflow openings, e.g. 15 and 16, an axially directed flow of exhaust gas is created through the interior of the pipe 1. This axial flow of exhaust gas, which is pulsating, mixes with the exhaust gases flowing into the interior of pipe 1 from the damping chambers 7,8,9, whereby the pressure differences in the interior of the pipe 1 are effectively equalized and the resistance to flow reduced.

As will be seen from FIG. 1, the length of respective damping chambers increases successively as seen from the inlet 2, in order to obtain successive gas expansion and therewith the best possible sound-damping effect.

I claim:

1. A silencer for exhaust gases from combustion engines, comprising a pipe (1) which is perforated along the wall thereof and provided with an inlet (2) and an outlet (3), and in the interior of which there are arranged fixed intermediate walls (12,13,14) which connect with the inner surface of said pipe, and which pipe (1) is surrounded by a gas-impermeable shell (4,5,6) which forms a space between itself and said pipe, said space being divided into a plurality of damping chambers (7,8,9), by partitions (10,11) abutting the shell and the pipe, said partitions being located between the intermediate walls, permitting exhaust gases to flow out of the pipe in front of an intermediate wall and into an adjacent damping chamber and from there back into the pipe behind said intermediate wall, characterized in that each intermediate wall (12,13,14) is provided with a plurality of through-flow openings (e.g. 15,16) so as to create a flow of exhaust gas in the axial direction of the perforated pipe which meets the flow of incoming gas in front of said intermediate wall.

2. A silencer according to claim 1, characterized in that the distance between the fixed intermediate walls (12,13,14) increases successively in the axial flow direction.

* * * * *